US008651171B2

(12) United States Patent
Yang

(10) Patent No.: US 8,651,171 B2
(45) Date of Patent: Feb. 18, 2014

(54) SINGLE FLOW CIRCUIT HEAT EXCHANGE DEVICE FOR PERIODIC POSITIVE AND REVERSE DIRECTIONAL PUMPING

(76) Inventor: Tai-Her Yang, Dzan-Hwa (TW)

( * ) Notice: Subject to any disclaimer, the term of this patent is extended or adjusted under 35 U.S.C. 154(b) by 470 days.

(21) Appl. No.: 12/292,307

(22) Filed: Nov. 17, 2008

(65) Prior Publication Data

US 2010/0122801 A1 May 20, 2010

(51) Int. Cl.

| | |
|---|---|
| ***F28F 27/00*** | (2006.01) |
| ***F28F 27/02*** | (2006.01) |
| ***F28D 17/00*** | (2006.01) |
| ***F23L 15/02*** | (2006.01) |

(52) U.S. Cl.
USPC ..... 165/200; 165/4; 165/11.1; 165/97

(58) Field of Classification Search
USPC ..... 165/4, 8, 10, 11.1, 200, 201, 60, 165/104.21, 111, 115, 97
See application file for complete search history.

(56) References Cited

U.S. PATENT DOCUMENTS

| | | | | | |
|---|---|---|---|---|---|
| 3,978,912 | A * | 9/1976 | Penny et al. | 165/4 |
| 4,062,189 | A * | 12/1977 | Mager et al. | 165/104.21 |
| 4,171,622 | A * | 10/1979 | Yamaguchi et al. | 62/324.1 |
| 4,173,865 | A * | 11/1979 | Sawyer | 62/324.6 |
| 4,262,493 | A * | 4/1981 | Lackey et al. | 62/324.6 |
| 4,429,732 | A * | 2/1984 | Moscrip | 165/10 |
| 4,483,156 | A * | 11/1984 | Oudenhoven | 62/324.1 |
| 4,582,765 | A * | 4/1986 | Kothmann | 165/97 |
| 4,832,115 | A * | 5/1989 | Albers et al. | 165/111 |
| 5,020,335 | A * | 6/1991 | Albers et al. | 165/115 |
| 5,123,481 | A * | 6/1992 | Albers et al. | 165/111 |
| 5,190,095 | A * | 3/1993 | Fujimoto et al. | 165/97 |
| 5,313,804 | A * | 5/1994 | Kaye | 62/324.4 |
| 5,385,123 | A * | 1/1995 | Evans | 123/41.21 |
| 5,461,876 | A * | 10/1995 | Dressler | 62/238.7 |
| 5,706,670 | A * | 1/1998 | Voorhis | 62/324.6 |
| 5,758,514 | A * | 6/1998 | Genung et al. | 62/324.4 |
| 5,813,244 | A * | 9/1998 | Palmer | 62/324.6 |
| 6,077,158 | A * | 6/2000 | Lake et al. | 454/70 |
| 6,118,099 | A * | 9/2000 | Lake et al. | 62/323.1 |
| 6,138,466 | A * | 10/2000 | Lake et al. | 62/238.7 |
| 6,745,830 | B2 * | 6/2004 | Dinh | 165/274 |
| 6,866,092 | B1 * | 3/2005 | Molivadas | 165/104.21 |
| 7,484,374 | B2 * | 2/2009 | Pham et al. | 62/324.1 |
| 7,794,141 | B2 * | 9/2010 | Perry et al. | 374/44 |
| 7,908,881 | B2 * | 3/2011 | Kopko | 62/79 |

* cited by examiner

*Primary Examiner* — Ljiljana Ciric
(74) *Attorney, Agent, or Firm* — Bacon & Thomas, PLLC

(57) ABSTRACT

A heat exchanger having a single flow circuit, at least one fluid pump, and a periodic fluid direction-change operative control device for periodically changing the flow directions of the pumped fluid in a first or second direction.

10 Claims, 8 Drawing Sheets

SINGLE FLOW CIRCUIT HEAT EXCHANGE DEVICE FOR PERIODIC POSITIVE AND REVERSE DIRECTIONAL PUMPING

BACKGROUND OF THE INVENTION (a) Field of the Invention

The present invention further improves the conventional applications for various heat exchange devices or full heat exchange devices by controlling the periodic positive and reverse directional pumping of a single flow circuit on a heat exchanger. The periodic positive and reverse directional pumping fluid is passed through the heat exchanger by a fluid pump to promote the heat exchange in the heat exchange device by improving the temperature distribution status between the fluid and the heat exchanger and promoting the heat exchange efficiency of the heat exchange device. By periodically pumping the fluid in the positive and reverse directions in the single flow circuit of the full heat exchanger, which is interposed or coated with permeating type or absorption type desiccant material or is made of material or structure that has both heat absorbing and moisture absorbing functions, allows the heat transfer between the fluids for thermal energy recovery and dehumidification and for reducing the defects of impurity accumulation due to fixed directional flow.

(b) Description of the Prior Art

FIG. 1 is a block schematic view of the conventional single flow circuit of a heat exchanger having a pumping device for fixing the flow in a fixed direction. The fixed flow includes being applied in the heat exchange device or full heat exchange device. As shown in FIG. 1, the fluid is pumped into a first fluid port at one side having a first temperature and discharged out of a second fluid port at another side with a second different temperature by a unidirectional fluid pump (120). As the fluid flow direction is fixed, the temperature difference distribution gradient inside the heat exchanger is unchanged. FIG. 2 shows the temperature distribution diagram of the conventional single flow circuit of a directional pumping thermal fluid; where the temperature difference between the heat exchanger and the single flow pumping fluid gradually approached one another with time; thereby gradually reducing its efficiency.

In addition, fluid can be pumped in the positive and reverse directions for a fixed preset period. However, the temperature can be different at the two fluid ports according to environmental changes, thus it has drawback of reducing the heat exchanging efficiency accordingly.

Moreover, if the heat exchanger (100) as shown in FIG. 1 is replaced by a full heat exchanger (111) having heat exchange and dehumidification functions, the humidity and temperature differences between the full heat exchanger and unidirectional pumped fluid gradually approaches one another thereby reducing its efficiency. As seen in FIG. 3, the heat exchanger of FIG. 1 is replaced by the full heat exchanger having heat exchange function and dehumidification function is shown.

SUMMARY OF THE INVENTION

The conventional heat exchange device having fixed directional pumped fluids is improved by having the single flow-circuit operable in a periodic positive and reverse directional pumping to obtain one or more of the following functions: 1) the temperature difference distribution at the two ends between the fluid and the heat exchanger (100) during the heat absorbing and release operating process is changed by the periodic positive and reverse directional pumping of the fluid in different flow directions to promote the heat exchange efficiency of the heat exchange device; 2) the heat exchange applications of the heat exchanger (100), which may be interposed or coated with permeating type or absorbing type desiccant material, or the material or structure of the heat exchanger itself has a moisture absorbing function, or the fluid piping is externally connected in series with the full heat exchange device, or series connected with piping having both heat exchange functions and moisture absorbing functions, can be changed by periodically manipulating the flow rate, or flow direction, or both of the flowing fluid allowing the differences in the temperature and humidity saturation temperatures between the fluid and the heat exchanger, which may be interposed or coated with permeating type or absorbing type desiccant material, or the differences in the temperature and humidity saturation temperatures between the full heat exchanger (200), which may further include a moisture absorbing function, and the fluid promotes the heat exchange function of the full heat exchange device for heat exchange thermal recovery and dehumidification functional operations; 3) the composition of the exchanging fluid can be detected by installing a gaseous or liquid fluid composition detecting device for controlling the flow direction, or flow rate, or both of the exchanging fluid; 4) the impurities or pollutants brought in by the fluid flow in a previous flow direction is discharged by the single flow circuit during the periodic positive and reverse directional pumping of the fluid to reduce the disadvantages of impurities or pollutants that accumulate in fixed flow direction.

DESCRIPTION OF MAIN COMPONENT SYMBOLS

Figure 1:
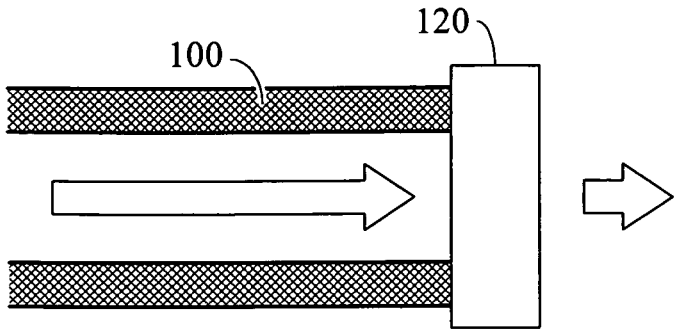
FIG. 1 (Prior Art)
FIG. 1 is a schematic view showing operating principles of the conventional heat exchange device or full heat exchange device.
Figure 2:
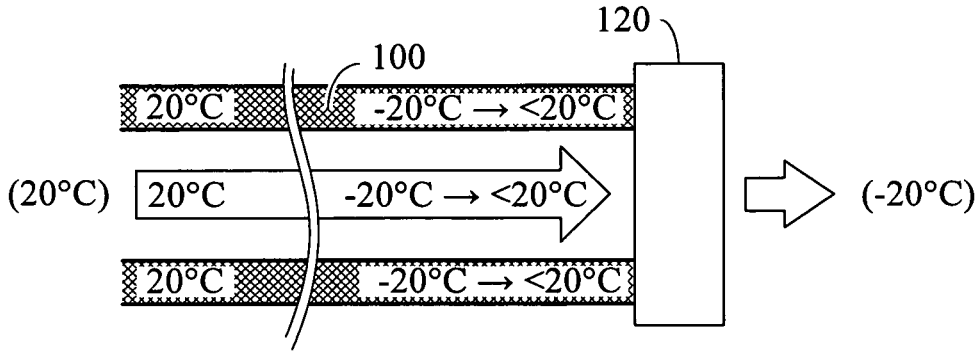
FIG. 2 (Prior Art)
FIG. 2 is the temperature distribution diagram of the conventional single flow directional pumping thermal fluid.
Figure 3:
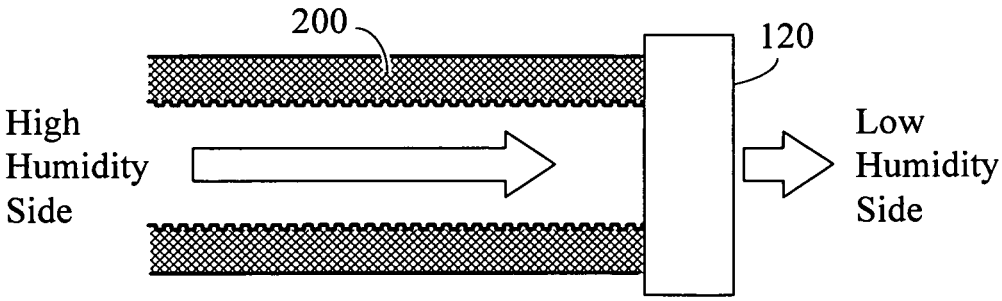
FIG. 3 (Prior Art)
FIG. 3 is a schematic view showing the heat exchanger in FIG. 1 being replaced by the full heat exchanger having both heat exchange function and dehumidification function.

11: Temperature detecting device
21: Humidity detecting device
31: Gaseous or liquid fluid composition detecting device
100: Heat exchanger
120: Unidirectional fluid pump
123: Bidirectional fluid pumping device
200: Full heat exchanger
126: Unidirectional valve
129, 129': Fluid valve
250: Periodic fluid direction-change operative control device
300: Power Source
a, b: Fluid port

DETAILED DESCRIPTION OF THE PREFERRED EMBODIMENTS

Figure 4:
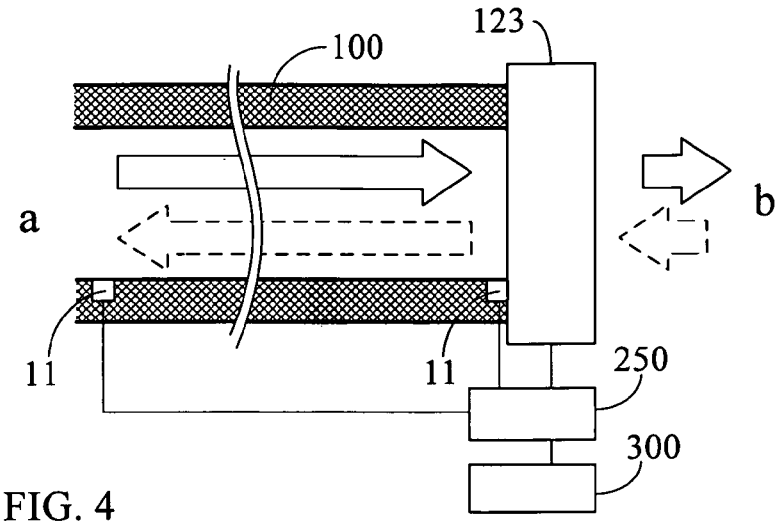
FIG. 4 is a first schematic view showing the single flow circuit heat exchange device for periodic positive and reverse directional pumping of the installed with a bidirectional fluid pump with positive and reverse pumping fluid function on one side thereof.

FIG. 4 shows a first schematic view of the structure principles of a single flow circuit heat exchange device for periodic positive and reverse directional pumping installed with a bidirectional fluid pump which can pump in the positive and reverse directions.

The single flow circuit heat exchange device for periodic positive and reverse directional pumping of the present invention can further be installed with a bidirectional fluid pump with a positive and reverse directional pumping function on one end of the conventional heat exchange device to comprise the bidirectional fluid pumping device (123). Additionally, the heat exchange device can be installed with a periodic fluid direction-change operative control device (250) for operatively controlling the bidirectional fluid pumping device (123) by periodically changing the direction of the pumped fluid from a fixed flow direction to alternately flow in a different direction.

The bidirectional fluid pumping device (123) is capable of producing positive pressure to push fluid; or is capable of producing negative pressure to attract fluid; or can have both functions of producing positive pressure to push fluid and negative pressure to attract fluid for pumping gaseous or liquid state fluids. The fluid pump can be driven by electric motor, engine power, or mechanical or electric power converted from other wind power, thermal energy, temperature-difference energy, or solar energy, etc.

The heat exchanger (100) has internal flow channels with heat absorbing/release capability, and is configured to generate heat an absorbing/release function to the fluid is pumped through the internal flow channels.

Power source (300) provides the power for operation, including AC or DC power system or acts as standalone electric power supplying devices.

The periodic fluid direction-change operative control device (250) can have electromechanical components, solid state electronic components, or microprocessors and relevant software and operative control interfaces to operatively control the bidirectional fluid pumping device (123) to periodically change the flow direction of the fluid passing through the heat exchange device to control the temperature difference distribution between the fluid and the heat exchanger (100) in the heat exchange device.

The timings for periodically changing the flow direction can be determined by one or more of the following: 1) the pumping direction of the bidirectional fluid pumping device (123) is manually operatively controlled, 2) the pumping direction of the bidirectional fluid pumping device (123) is controlled by the periodic fluid direction-change operative control device (250) by setting time a period according to temperature variations, or 3) the at least one temperature detecting device (11) is installed at a position capable of directly or indirectly detecting the temperature variation of the pumped fluid, wherein the detected signals are transmitted to the periodic fluid direction-change operative control device (250), so when the setting temperature is reached, the pumping direction of the bidirectional fluid pumping device (123) is operatively controlled to pump the fluid in a reverse flow direction.

Figure 5:
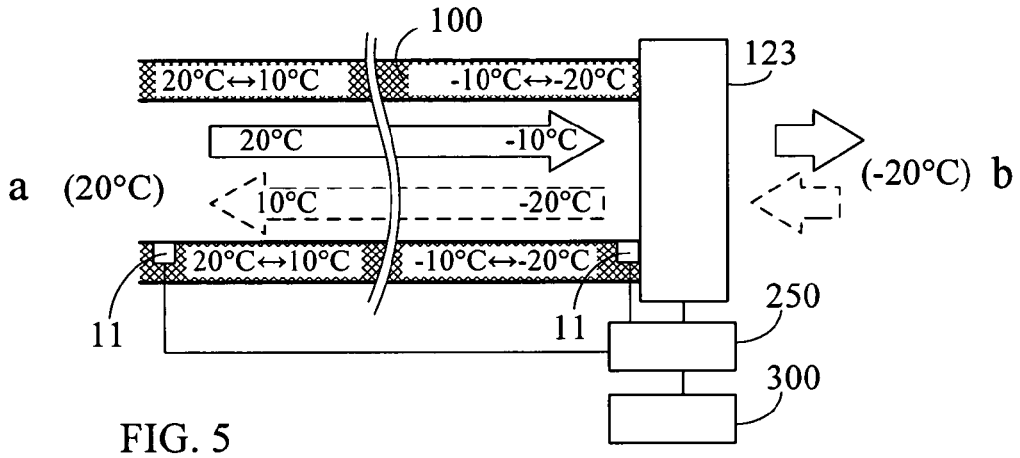
FIG. 5 is the temperature distribution variation diagram between the thermal fluid and the piping during the operation of the structure as shown in FIG. 4.

FIG. 5 is the temperature distribution variation diagram between the thermal fluid and the piping during the operation as shown in FIG. 4.

As shown in FIG. 5, the fluid passing through the heat exchanger (100) installed in the heat exchange device has a periodically changing fluid pumping direction. For example, a heat exchange device for indoor-outdoor air change in cold winter times has a higher indoor temperature air flow which is pumped through the heat exchange device via first fluid port (a) and is discharged to outdoors via second fluid port (b) of heat exchanger by the bidirectional fluid pumping device (123), which is driven by the power of power source (300). The heat exchanger (100) of the heat exchange device then gradually has a temperature distribution from high temperature at first fluid port (a) to a lower temperature at second fluid port (b). To change the temperature distribution, the heat exchange device can be controlled so that: 1) the pumping direction of the bidirectional fluid pumping device (123) is manually operatively controlled, or 2) the pumping direction of the bidirectional fluid pumping device (123) is operatively controlled by the periodic fluid direction-change operative control device (250) by setting a time period according to temperature variations, or 3) the at least one temperature detecting device (11) is installed at a position capable of directly or indirectly detecting the temperature variation of the fluid, wherein the detecting signals of the temperature detecting device (11) are transmitted to the periodic fluid direction-change operative control device (250), whereby when a setting temperature is reached, the pumping direction of the bidirectional fluid pumping device (123) is operatively controlled to pump the fluid in a reverse flow direction. When the fluid flow changes direction, the fluid having the lower temperature from the outdoor fresh air is pumped by the heat exchange device via the second fluid port (b) to the indoors via first fluid port (a). The heat exchanger (100) of the heat exchange device gradually has a temperature distribution having a lower temperature at second fluid port (b) to the higher temperature at first fluid port (a), so that the temperature distribution status on the heat exchanger (100) is changed by the periodic positive and reverse directional pumping of the fluid.

Figure 6:
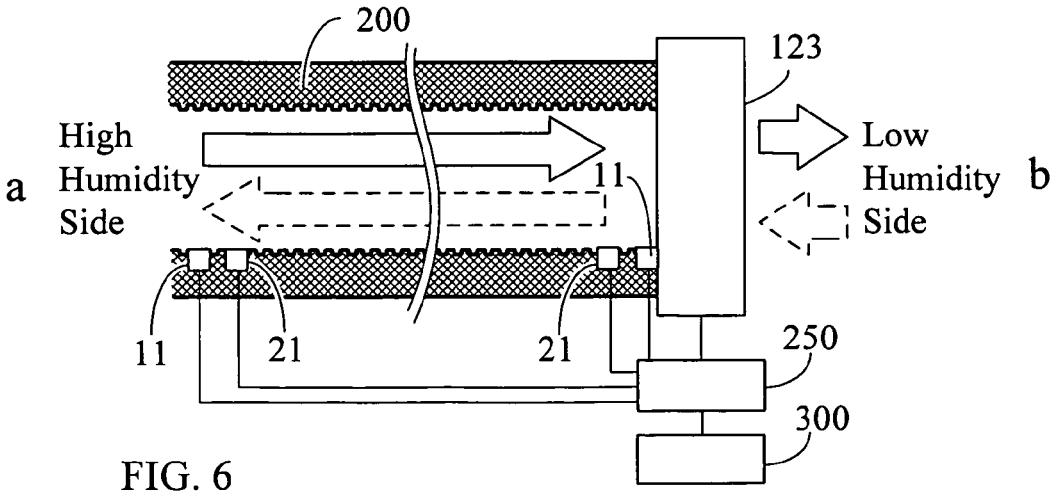
FIG. 6 is a schematic view showing the heat exchanger of FIG. 4 replaced with a full heat exchanger having both heat exchange function and dehumidification function.

FIG. 6 shows the heat exchanger of FIG. 4 having a full heat exchanger having both a heat exchange function and dehumidification function.

FIG. 6 shows the device for periodic positive and reverse directional pumping of the fluid, as shown in FIG. 4, being applied to a full heat exchange device (200). The heat exchange device (200) can be interposed or coated with permeating type or absorbing type desiccant material, or the heat exchanger of the full heat exchanger itself can be made of material or have a structure to have a moisture absorbing function. The periodic positive and reverse directional pumping can be applied to this structure by: 1) the pumping direction of the bidirectional fluid pumping device (123) is manually operatively controlled, or 2) the pumping direction of the bidirectional fluid pumping device (123) is operatively controlled by the periodic fluid direction-change operative control device (250) by setting a time period according to temperature variations, or setting a time period according to humidity variations, or setting time period according to temperature and humidity variations simultaneously, or 3) the at least one temperature detecting device (11) and at least one humidity detecting device (21) can be installed at a position capable of directly or indirectly detecting the temperature variation and humidity variation of the pumped fluid, which includes being installed with both or at least one detecting device, wherein the detected signals of the temperature detecting device (11) and the humidity detecting device (21) are transmitted to the periodic fluid direction-change operative control device (250), so as when the full heat exchanger (200) reaches both or either one of the setting temperature or setting humidity, the bidirectional fluid pumping device (123) is operatively controlled to pump the fluid in the reverse flow direction. The pumped fluid has two different flow directions for passing through the full heat exchanger (200) inside the heat exchange device to change the distribution status of the temperature and humidity between the fluid and the full heat exchanger by changing the flow direction of the fluid.

Said temperature detecting device (11) and the humidity detecting device (21) can be constructed as an integral structure or separately installed.

Further, the single flow circuit heat exchange device for periodic positive and reverse directional pumping can have two unidirectional fluid pumps connected in series to comprise the bidirectional fluid pumping device (123) to pump in different pumping directions.

Figure 7:
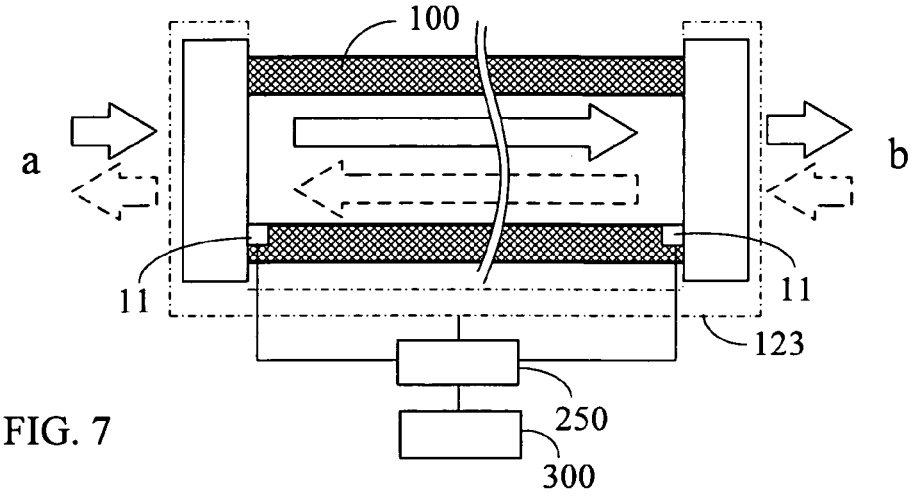
FIG. 7 is a second schematic view showing a single flow circuit heat exchange device for periodic positive and reverse directional pumping having the bidirectional fluid pumping device comprising two unidirectional fluid pumps in different flow pumping directions.

FIG. 7 shows the single flow circuit heat exchange device having the bidirectional fluid pumping device comprising two unidirectional fluid pumps which pump in different flow directions.

As shown in FIG. 7, the fluid pump that pumps in the positive and reverse direction of FIG. 4 is replaced by two reverse unidirectional fluid pumps (120) which are installed to pump by turns. These unidirectional fluid pumps (120) are installed at the two ends of the heat exchanger (100) to perform the function of the bidirectional fluid pumping device (123), and are thereby subject to the operative control of the periodic fluid direction-change operative control device (250). The operating principal and the control timing in this example are the same with that of the embodiment shown in FIG. 4.

Figure 8:
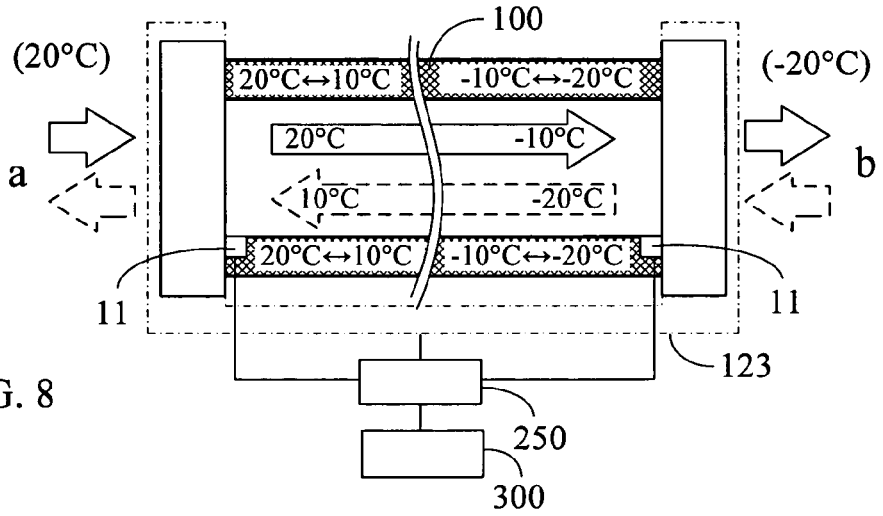
FIG. 8 is the temperature distribution variation diagram between the thermal fluid and the piping during the operation of the structure shown in FIG. 7.

FIG. 8 is the temperature distribution variation diagram between the thermal fluid and the piping during the operation as shown in FIG. 7

As shown in FIG. 8, the fluid passing through the heat exchanger (100) installed in the heat exchange device has a periodically changing fluid pumping direction. For example, a heat exchange device for indoor-outdoor air change in cold winter times has a higher indoor temperature air flow which is pumped through the heat exchanger (100) via the first fluid port (a) and is discharged to the outdoors via second fluid port (b) by the bidirectional fluid pumping device (123), which is driven by the power of power source (300). The heat exchanger (100) of the heat exchange device then gradually has a temperature distribution from high temperature at the first fluid port (a) to the lower temperature at the second fluid port (b). To change the temperature distribution, the heat exchange device can be controlled so that: 1) the pumping direction of the bidirectional fluid pumping device (123) is manually operatively controlled, or 2) the pumping direction of the bidirectional fluid pumping device (123) is operatively controlled by the periodic fluid direction-change operative control device (250) by setting a time period according to temperature variations, or 3) the at least one temperature detecting device (11) is installed at a position capable of directly or indirectly detecting the temperature variation of the fluid, wherein the detecting signals of the temperature detecting device (11) are transmitted to the periodic fluid direction-change operative control device (250), whereby when a setting temperature is reached, the pumping direction of the bidirectional fluid pumping device (123) is operatively controlled to pump the fluid in a reverse flow direction. When the fluid flow changes direction, the fluid having the lower temperature from the outdoor fresh air is pumped by the heat exchange device via the second fluid port (b) to the indoors via first fluid port (a). The heat exchanger (100) of the heat exchange device gradually has a temperature distribution having a lower temperature at second fluid port (b) to the higher temperature at first fluid port (a), so that the temperature distribution status on the heat exchanger (100) is changed by the periodic positive and reverse directional pumping of the fluid.

Figure 9:
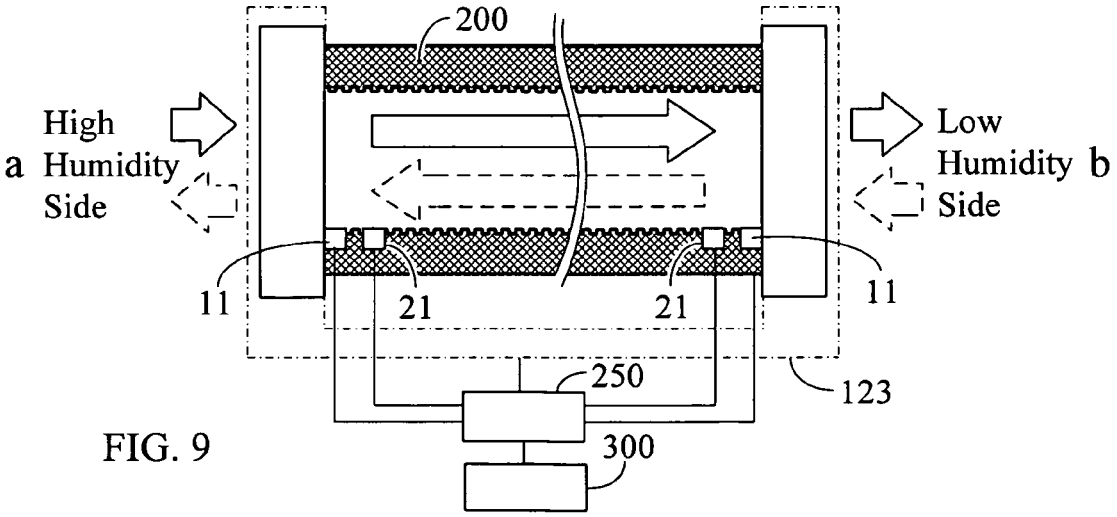
FIG. 9 is a schematic view showing the heat exchanger of FIG. 7 replaced by the full heat exchanger having both heat exchange function and dehumidification function.

FIG. 9 shows the heat exchanger of FIG. 7 being replaced to the full heat exchanger having both heat exchange function and dehumidification function.

FIG. 9 shows the device for periodic positive and reverse directional pumping of the fluid as shown in FIG. 7, being applied to a full heat exchange device (200). The heat exchange device (200) can be interposed or coated with permeating type or absorbing type desiccant material, or for the heat exchanger of the full heat exchanger itself can be made of material or have a structure to have moisture absorbing function. The periodic positive and reverse directional pumping can be applied to this structure by: 1) the pumping direction of the bidirectional fluid pumping device (123) is manually operatively controlled, or 2) the pumping direction of the bidirectional fluid pumping device (123) is operatively controlled by the periodic fluid direction-change operative control device (250) by setting a time period according to temperature variations, or setting a time period according to humidity variations, or setting time period according to temperature and humidity variations simultaneously, or 3) the at least one temperature detecting device (11) and at least one humidity detecting device (21) can be installed at a position capable of directly or indirectly detecting the temperature variation and humidity variation of the pumped fluid, which includes being installed with both or at least one detecting device, wherein the detected signals of the temperature detecting device (11) and the humidity detecting device (21) are transmitted to the periodic fluid direction-change operative control device (250), so that when the full heat exchanger (200) reaches both or either one of the setting temperature and setting humidity, the bidirectional fluid pumping device (123) is operatively controlled to pump the fluid in the reverse flow direction. The pumped fluid has two different flow directions for passing through the full heat exchanger (200) inside the heat exchange device to change the distribution status of the temperature and humidity between the fluid and the full heat exchanger by changing the flow direction of the fluid.

Said temperature detecting device (11) and the humidity detecting device (21) can be constructed as an integral structure or separately.

The single flow-circuit heat exchange device for periodic positive and reverse directional pumping can be further installed with all or at least one or more than one detecting device, such as a temperature detecting device (11), humidity detecting device (21), and gaseous or liquid fluid composition detecting device (31), on the heat exchange device (1000), heat exchanger (100) or total heat exchanger (200). The at least one or more than one detecting device can be positioned near both or one of the first fluid port (a) and the second fluid port (b), or at other positions capable of detecting properties of exchanging fluids. The detected signal serve as references for the operation of one or more of the following functions: 1) as the reference for operatively controlling the periodic switch timing of fluid flowing direction pumped by the bi-directional fluid pumping devices (123); or 2) as the reference for operatively controlling the bi-directional fluid pumping devices (123) to control the speed or the flow rate of the pumping fluid; or 3) as the reference for operatively controlling the open volume of the fluid valve to control the speed or the flow rate of the pumping fluid.

For the aforementioned temperature detecting device (11), humidity detecting device (21), and the gaseous or liquid fluid composition detecting device (31), all detecting devices can be constructed as an integral structure, or partial detecting devices can be constructed as an integral structure, or each detecting device can be separately installed.

Figure 10:
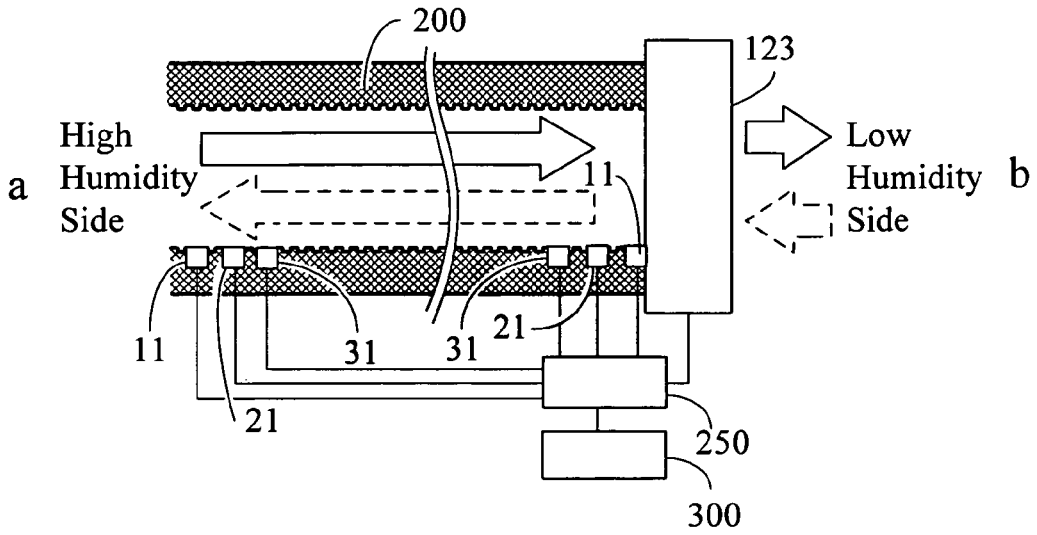
FIG. 10 illustrates the structure of FIG. 6 additionally installed with the gaseous or liquid fluid composition detecting device.

As shown in FIG. 10, the heat exchange device of FIG. 6 is additionally installed with the gaseous or liquid fluid composition detecting device.

FIG. 10 shows that the bi-directional fluid pumping device (123) comprises the bidirectional fluid pump with positive and reverse directional pumping function installed on single side as shown in FIG. 6. The full heat exchange device (200) has a heat exchanger that can be interposed or coated with permeating type or absorbing type desiccant material, or the heat exchanger of the full heat exchanger itself can be made of material or have a structure further having a moisture absorbing function. In this embodiment, the flow of the pumped fluid can be controlled by: 1) the pumping direction of the bidirectional fluid pumping device (123) which is manually controlled, or 2) the pumping direction of the bidirectional fluid pumping device (123) is controlled by the periodic fluid direction-change control device (250) by setting a time period according to temperature variations, or setting a time period according to humidity variations, or setting a time period according to temperature and humidity variations simultaneously, or 3) the at least one temperature detecting device (11), at least one humidity detecting device (21), and/or at least one gaseous or liquid fluid composition detecting device (31) are installed in a position capable of directly or indirectly detecting the temperature variation, humidity variation, and gaseous or liquid fluid composition variation respectively, wherein the detected signals are transmitted to the periodic fluid direction-change operative control device (250) to control the pumping direction of the bidirectional fluid pumping device (123) which comprises the bidirectional fluid pump with the positive and reverse directional pumping function to pump the fluid in a reverse flow direction. The pumped fluid has two different flow directions for passing through the full heat exchanger (200) inside the heat exchange device to change the distribution status of the temperature and humidity between the fluid and the full heat exchanger by changing the flow direction of the fluid.

Figure 11:
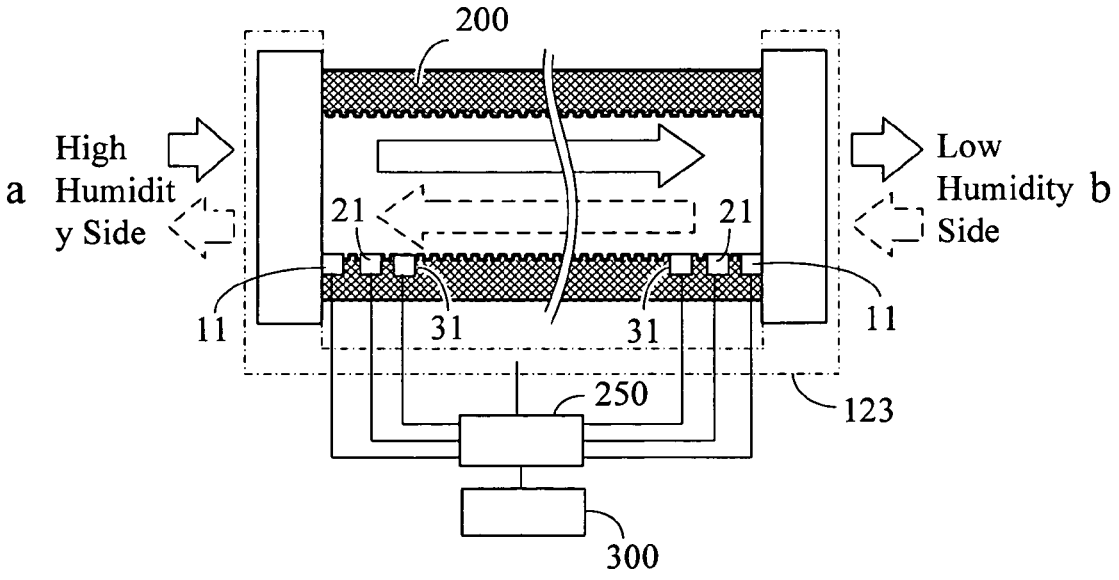
FIG. 11 depicts the structure of FIG. 9 being installed with the gaseous or liquid fluid composition detecting device.

As shown in FIG. 11 shows the heat exchanger of FIG. 9 additionally installed with the gaseous or liquid fluid composition detecting device.

FIG. 11 shows that the bi-directional fluid pumping device (123) comprises the unidirectional fluid pumps (120) on both ends of the heat exchanger that pump alternately in reverse directions as shown in FIG. 9. The full heat exchange device (200) has a heat exchanger that can be interposed or coated with permeating type or absorbing type desiccant material, or for the heat exchanger of the full heat exchanger itself can be made of material or have a structure further having a moisture absorbing function. In this embodiment, the flow of the pumped fluid can be controlled by: 1) the pumping direction of the bidirectional fluid pumping device (123) which is manually controlled, or 2) the pumping direction of the bidirectional fluid pumping device (123) is controlled by the periodic fluid direction-change operative control device (250) by setting a time period according to temperature variations, or setting a time period according to humidity variations, or setting a time period according to temperature and humidity variations simultaneously, or 3) the at least one temperature detecting device (11), at least one humidity detecting device (21), and/or at least one gaseous or liquid fluid composition detecting device (31) can be installed in a position capable of directly or indirectly detecting the temperature variation, humidity variation, and gaseous or liquid fluid composition variation respectively, wherein the detected signals are transmitted to the periodic fluid direction-change operative control device (250) to control the pumping direction of the bidirectional fluid pumping device (123) which comprises the unidirectional fluid pumps (120) to alternately pump in reverse direction to pump the fluid in reverse flow direction. The pumped fluid has two different flow directions for passing through the full heat exchanger (200) inside the heat exchange device to change the distribution status of the temperature and humidity between the fluid and the full heat exchanger by changing the flow direction of the fluid.

Said temperature detecting device (11), humidity detecting device (21), and gaseous or liquid fluid composition detecting device (31) can be constructed as an integral structure or separately installed.

Figure 12:
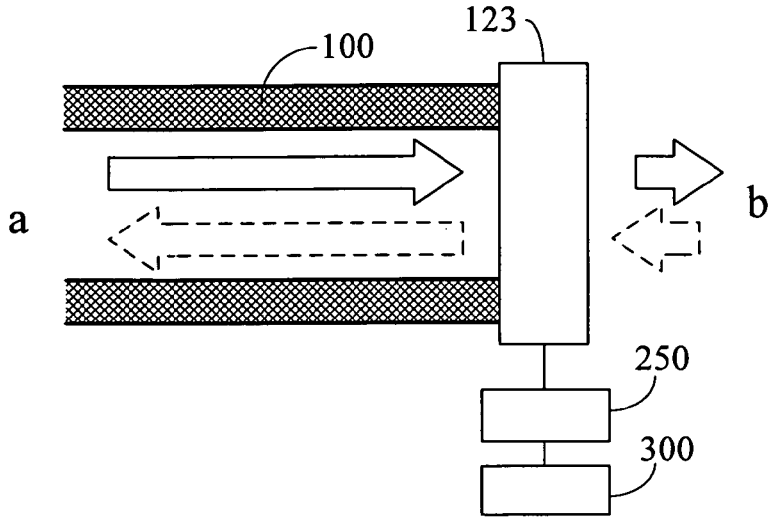
FIG. 12 illustrates the present invention having at least one fluid pump capable of bidirectionally pumping the fluid which is installed at a position on either one of the first fluid port (a) or the second fluid port (b) of the heat exchanger.
Figure 13:
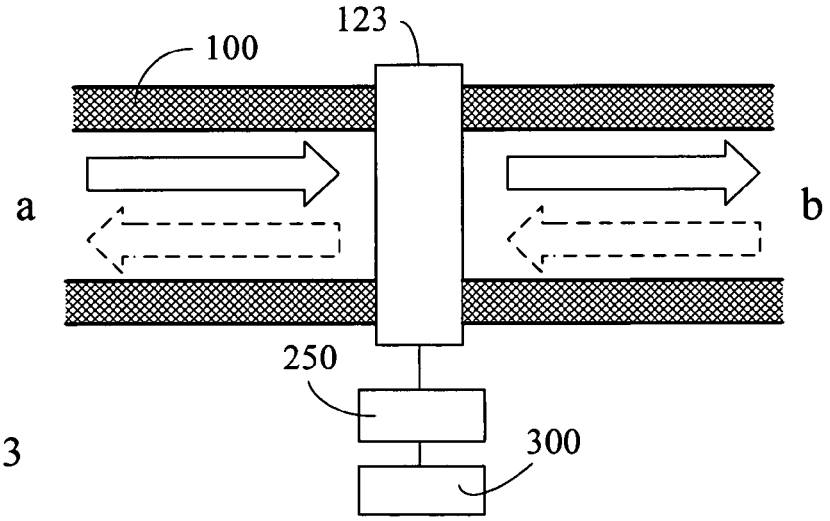
FIG. 13 shows the heat exchanger having at least one fluid pump capable of bidirectionally pumping the fluid which is installed in the middle of the heat exchanger.
Figure 14:
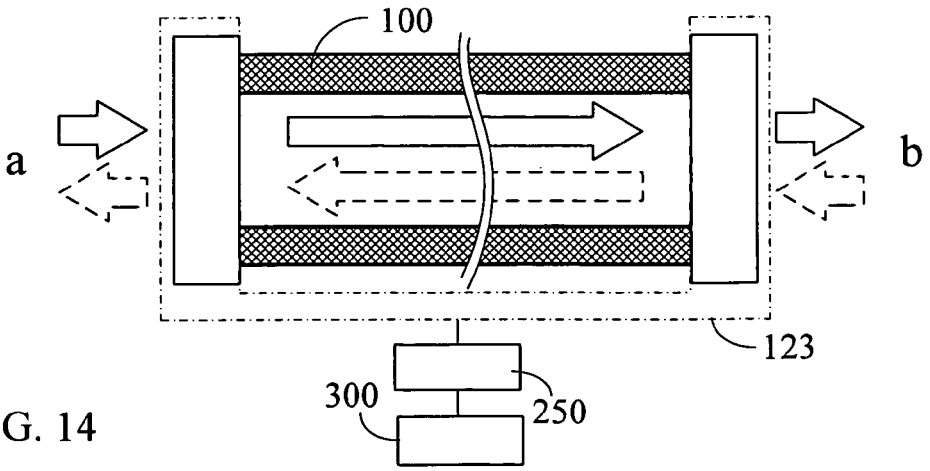
FIG. 14 depicts the heat exchanger having at least two fluid pumps capable of bidirectionally pumping the fluid which are respectively installed on the first fluid port (a) and the second fluid port (b) at the two ends of the heat exchanger.
Figure 15:
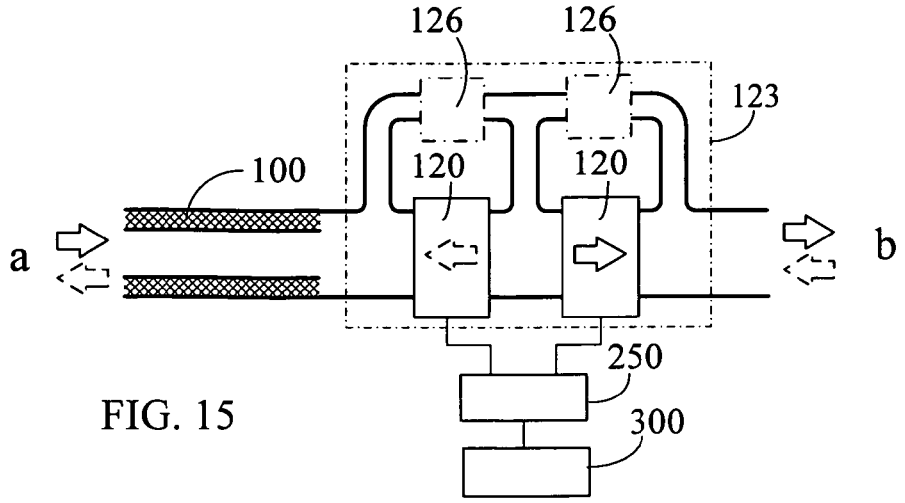
FIG. 15 illustrates the heat exchanger having at least two unidirectional fluid pumps in different pumping directions being series connected to constitute the bidirectional fluid pumping device which are installed at a position on either one of the first fluid port (a) or the second fluid port (b) of the heat exchanger.
Figure 16:
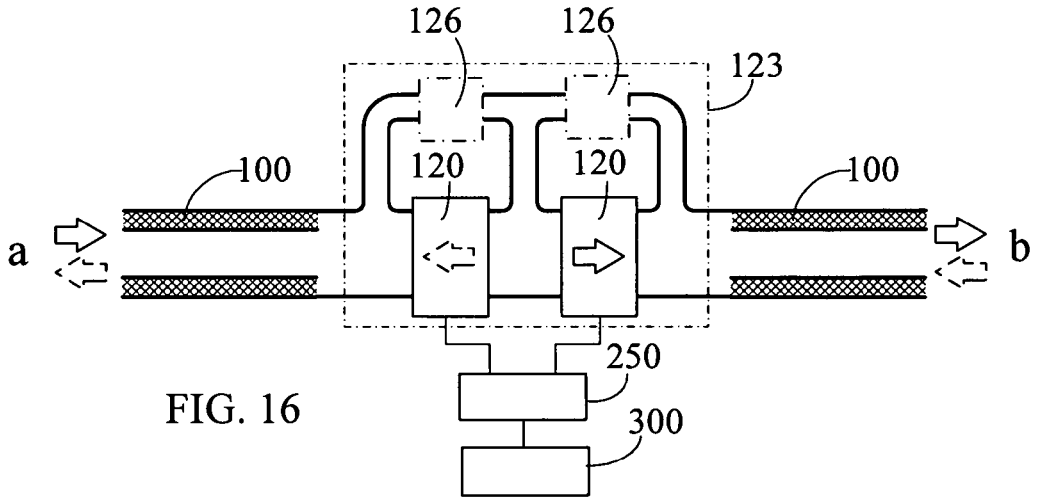
FIG. 16 shows the heat exchanger having at least two unidirectional fluid pumps pumping in different directions which are connected in series to comprise the bidirectional fluid pumping device are installed at the middle section of the heat exchanger.
Figure 17:
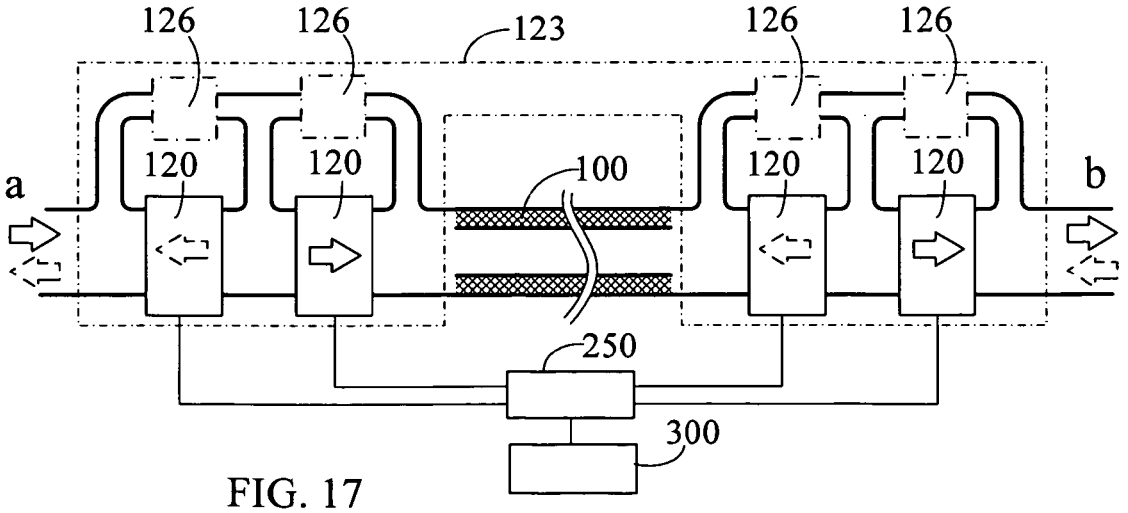
FIG. 17 illustrates the heat exchanger having at least two unidirectional fluid pumps pumping in different directions which are connected in series to comprise the bidirectional fluid pumping device and are installed on the first fluid port (a) and the second fluid port (b) at the two ends of the heat exchanger.

According to the operating functions as described above, the bidirectional fluid pumping device (123) of the single flow circuit heat exchange device for periodic positive and reverse directional pumping can comprise one or more of the following structures:

1. Having at least one fluid pump which is capable of bidirectionally pumping the fluid and is installed at a position on either the first fluid port (a) or the second fluid port (b) of the heat exchanger (100) to control the bidirectional pumping of the fluid to periodically pump in the positive or reverse directions by the periodic fluid direction-change operative control device (250) to periodically change the fluid direction. As shown in FIG. 12, the at least one fluid pump which is capable of bidirectionally pumping the fluid is installed at a position on either the first fluid port (a) or the second fluid port (b) of the heat exchanger.
2. Having at least one fluid pump which is capable of bidirectionally pumping the fluid installed in the middle of the heat exchanger (100) to control the bidirectional pumping of the fluid to periodically pump in the positive or reverse directions by the periodic fluid direction-change operative control device (250) to periodically change the fluid direction. As shown in FIG. 13, the at least one fluid pump is capable of bidirectionally pumping the fluid and is installed in the middle of the heat exchanger.
3. Having at least two fluid pumps capable of bidirectionally pumping the fluid installed on the first fluid port (a) and the second fluid port (b) at the two ends of the heat exchanger (100) and controlled by the periodic fluid direction-change operative control device (250) to allow the single flow circuit heat exchange device to periodically pump in the positive and reverse pumping direction and having one or more of the following operational functions: 1) simultaneously pumping in the same direction as well as simultaneously changing the pumping direction periodically, or 2) one of the fluid pumps is capable of bidirectionally pumping the fluid and is installed on the first fluid port (a) or the second fluid port (b) to alternately pump in different directions. As shown in FIG. 14, this embodiment has at least two fluid pumps which are capable of bidirectionally pumping the fluid and are installed on the first fluid port (a) and the second fluid port (b) at the two ends of the heat exchanger.
4. Having at least two unidirectional fluid pumps (120), which pump in different pumping directions, connected in series to comprise the bidirectional fluid pumping device which are installed at a position on either one of the first fluid port (a) or the second fluid port (b) of the heat exchanger (100). The unidirectional fluid pumps (120) are controlled by the periodic fluid direction-change operative control device (250) to alternately use one of the unidirectional fluid pumps (120) to periodically pump in one direction, thereby periodically changing the fluid direction. If the unidirectional fluid pump (120) constituting the bidirectional fluid pumping device (123) is irreversible, the individual unidirectional fluid pump can be connected in parallel with a reversible unidirectional valve (126). As shown in FIG. 15, this embodiment has at least two unidirectional fluid pumps in different pumping directions and are connected in series to comprise the bidirectional fluid pumping device which are installed at a position on either one of the first fluid port (a) or the second fluid port (b) at one end of the heat exchanger.
5. Having at least two unidirectional fluid pumps (120), which pump in different pumping directions, connected in series to comprise the bidirectional fluid pumping device and is installed at the middle section of the heat exchanger (100). The unidirectional fluid pumps (120) are controlled by the periodic fluid direction-change operative control device (250) to alternately use one of the unidirectional fluid pumps to periodically pump in one direction, thereby periodically changing the fluid direction. If the unidirectional fluid pump (120), which comprises the bidirectional fluid pump device (123) is irreversible, the individual unidirectional fluid pump can be connected in parallel with a reversible unidirectional valve (126). As shown in FIG. 16, at least two unidirectional fluid pumps, which are connected in series, pump in different pumping directions to comprise the bidirectional fluid pumping device and are installed at the middle section of the heat exchanger.
6. Having at least two unidirectional fluid pumps (120), which pump in different pumping directions, are connected in series to comprise the bidirectional fluid pumping device and are installed on the first fluid port (a) and the second fluid port (b) at the two ends of the heat exchanger (100). The at least two unidirectional fluid pumps (120) are controlled by the periodic fluid direction-change operative control device (250) to control the unidirectional fluid pumps (120) in different pumping directions and to allow the single flow circuit heat exchange device to periodically pump in the positive and reverse directions. The control by the periodic fluid direction-change operative control device (250) can have one or more of the following functions: 1) the operation of simultaneously pumping in the same direction as well as simultaneously changing the pumping direction periodically, or 2) the unidirectional fluid pumps (120) can pump in different pumping directions, which are installed on the first fluid port (a) and the second fluid port (b), are subject to the control of the periodic fluid direction-change operative control device (250) to alternately pump one of the unidirectional fluid pumps in one direction, and then periodically changing the fluid direction. If the unidirectional fluid pump, which comprises the bidirectional fluid pump device (123) is irreversible, the individual unidirectional fluid pump can be connected in parallel with a reversible unidirectional valve (126). As shown in FIG. 17, at least two unidirectional fluid pumps, which are connected in series, can pump in different pumping directions to comprise the bidirectional fluid pumping device and are installed on the first fluid port (a) and the second fluid port (b) at the two ends of the heat exchanger.

Figure 18:
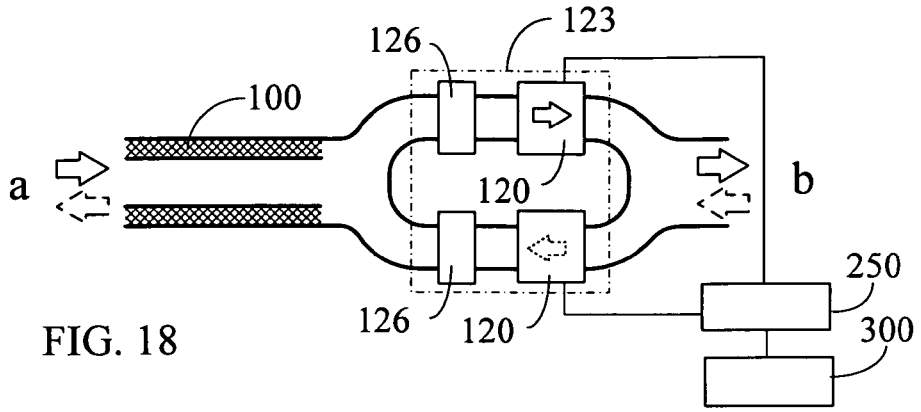
FIG. 18 shows the heat exchanger having at least two unidirectional fluid pumps pumping in different directions which are connected in parallel to comprise the bidirectional fluid pumping device and are installed at position on either one of the first fluid port (a) or the second fluid port (b) of the heat exchanger.

7. Having at least two unidirectional fluid pumps (120) in different pumping directions connected in parallel which comprises the bidirectional fluid pumping device are installed at a position on either one of the first fluid port (a) or the second fluid port (b) of the heat exchanger (100). The at least two unidirectional fluid pumps (120) can be controlled by the periodic fluid direction-change operative control device (250) to periodically control one of the unidirectional fluid pumps (120) to pump alternately, thereby periodically changing the fluid direction. If the structure of the adopted unidirectional fluid pump (120) does not have the anti-reverse flow function, the individual fluid pump can connected in series with a unidirectional valve (126) in forward polarity before being connected in parallel to avoid reverse flows. As shown in FIG. 18, at least two unidirectional fluid pumps pump in different pumping directions and are connected in parallel to comprise the bidirectional fluid pumping device. The at least two unidirectional fluid pumps can be installed at a position on either one of the first fluid port (a) and the second fluid port (b) at one end of the heat exchanger.

Figure 19:
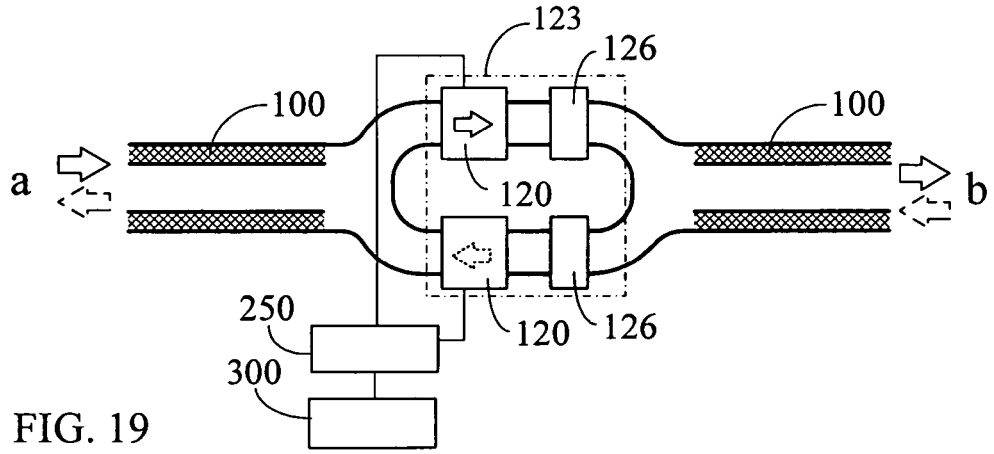
FIG. 19 illustrates the heat exchanger having at least two unidirectional fluid pumps pumping in different directions which are connected in parallel to comprise the bidirectional fluid pumping device and are installed at the middle section of the heat exchanger.

8. Having at least two unidirectional fluid pumps (120), which pump in different pumping directions, are connected in parallel to comprise the bidirectional fluid pumping device and is installed at the middle section of the heat exchanger (100). The at least two unidirectional fluid pumps can be controlled by the operative control of the periodic fluid direction-change operative control device (250) to periodically control one of the unidirectional fluid pumps (120) to alternately pump, thereby periodically changing the fluid direction. If the structure of the unidirectional fluid pump (120) does not have the anti-reverse flow function, the individual fluid pump can be connected in series with a unidirectional valve (126) in forward polarity before being connected in parallel to avoid reverse flows. As shown in FIG. 19, at least two unidirectional fluid pumps pump in different pumping directions and are connected in parallel to comprise the bidirectional fluid pumping device which are installed at the middle section of the heat exchanger.

Figure 20:
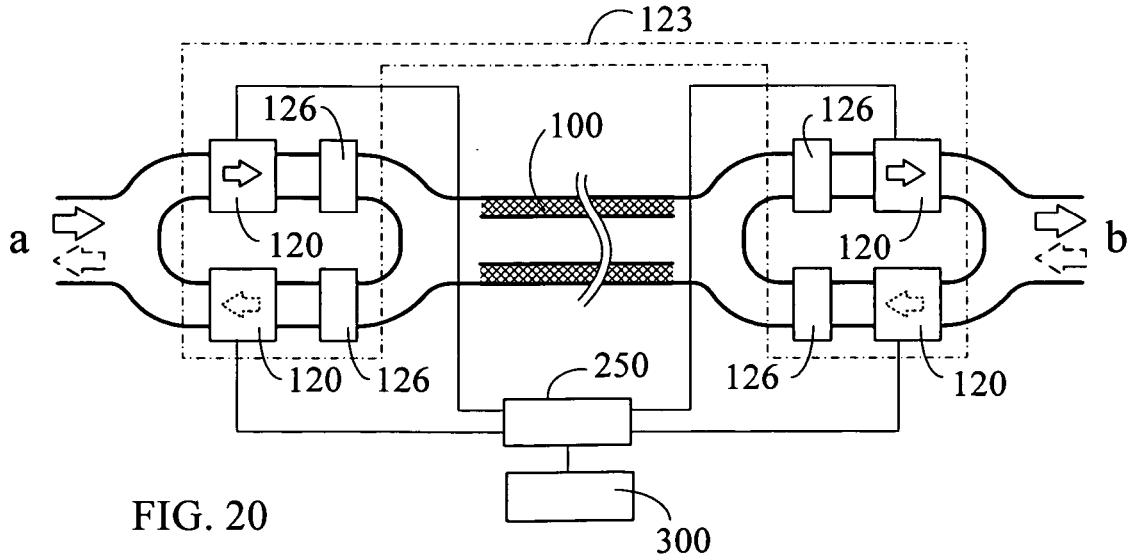
FIG. 20 illustrates the heat exchanger having at least two unidirectional fluid pumps pumping in different directions which are connected in parallel to comprise the bidirectional fluid pumping device and are installed on the first fluid port (a) and the second fluid port (b) at the two ends of the heat exchanger.

9. Having at least two unidirectional fluid pumps (120), which pump in different pumping directions, are connected in parallel to comprise the bidirectional fluid pumping device, are installed on the first fluid port (a) and the second fluid port (b) at the two ends of the heat exchanger (100). The at least two unidirectional fluid pumps are controlled by the periodic fluid direction-change operative control device (250) to control the unidirectional fluid pumps in different pumping directions and to allow the single flow circuit heat exchange device to periodically pump in the positive and reverse directions and has one or more of the following functions: 1) the operation of simultaneously pumping in the same direction as well as simultaneously changing the pumping direction periodically, or 2) the unidirectional fluid pumps (120) pump in different pumping directions and are installed on the first fluid port (a) and the second fluid port (b). The unidirectional fluid pumps are controlled by the periodic fluid direction-change operative control device (250) to periodically pump one of the unidirectional fluid pumps alternately in one direction, thereby periodically changing the fluid direction. If the unidirectional fluid pump (120) is irreversible, the individual unidirectional fluid pump can be connected in parallel with a reversible unidirectional valve (126). As shown in FIG. 20, at least two unidirectional fluid pumps can pump in different pumping directions and are connected in parallel to comprise the bidirectional fluid pumping device and can be installed on the first fluid port (a) and the second fluid port (b) at the two ends of the heat exchanger.

Figure 21:
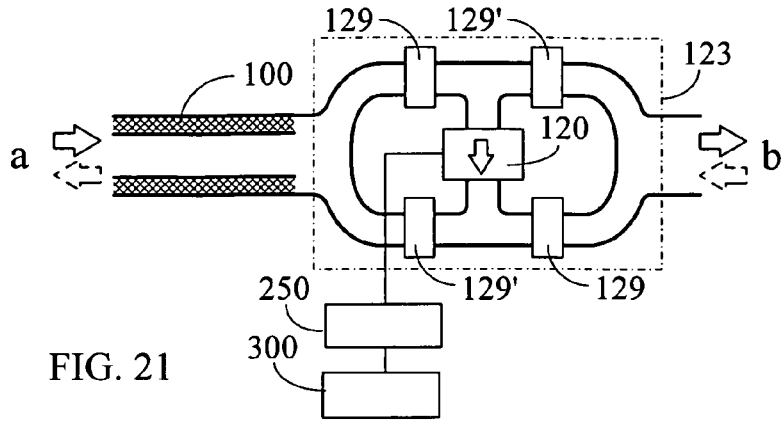
FIG. 21 shows that the heat exchanger has at least one unidirectional fluid pump and four controllable switch type fluid valves in bridge type, and is installed at a position on either one of the first fluid port (a) or the second fluid port (b) of the heat exchanger.

10. Having at least one unidirectional fluid pump (120) and four controllable switch type fluid valves (129, 129') in bridge type combination, and is installed at positions on either one of the first fluid port (a) or the second fluid port (b) of the heat exchanger (100). The at least one unidirectional fluid pump (120) and four controllable switch type fluid vales are controlled by the periodic fluid direction-change operative control device (250) to alternately control two fluid valves (129) to open and the other two fluid valves (129') to close or two fluid valves (120) to close and the other two fluid valves (129') to close during the operation of the unidirectional fluid pump (120), thereby periodically changing the fluid directions. As shown in FIG. 21, this embodiment has at least one unidirectional fluid pump and four controllable switch type fluid valves in bridge type which are installed at a position on either one of the first fluid port (a) or the second fluid port (b) at one end of the heat exchanger.

Figure 22:
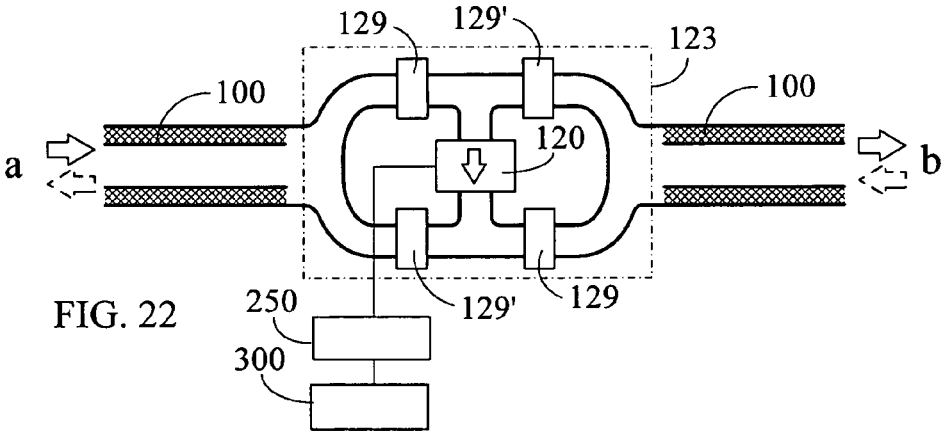
FIG. 22 shows that the heat exchanger has at least one unidirectional fluid pump and four controllable switch type fluid valves in bridge type, and is installed in a middle section of the heat exchanger.

11. Having at least one unidirectional fluid pump (120) and four controllable switch type fluid valves (129, 129') in bridge type combination, and installed at a middle section of the heat exchanger (100) thereby to alternately operative control two fluid valves (129) to open and the other two fluid valves (129') to close or two fluid valves (120) to close and the other two fluid valves (129') to close. The at least one unidirectional fluid pump (120) and four controllable switch type fluid vales (129, 129') are controlled by the periodic fluid direction-change operative control device (250) during the operation of the unidirectional fluid pump (120) to periodically change the fluid directions. As shown in FIG. 22, this embodiment has at least one unidirectional fluid pump and four controllable switch type fluid valves in bridge type, and are installed at middle section of the heat exchanger.

Figure 23:
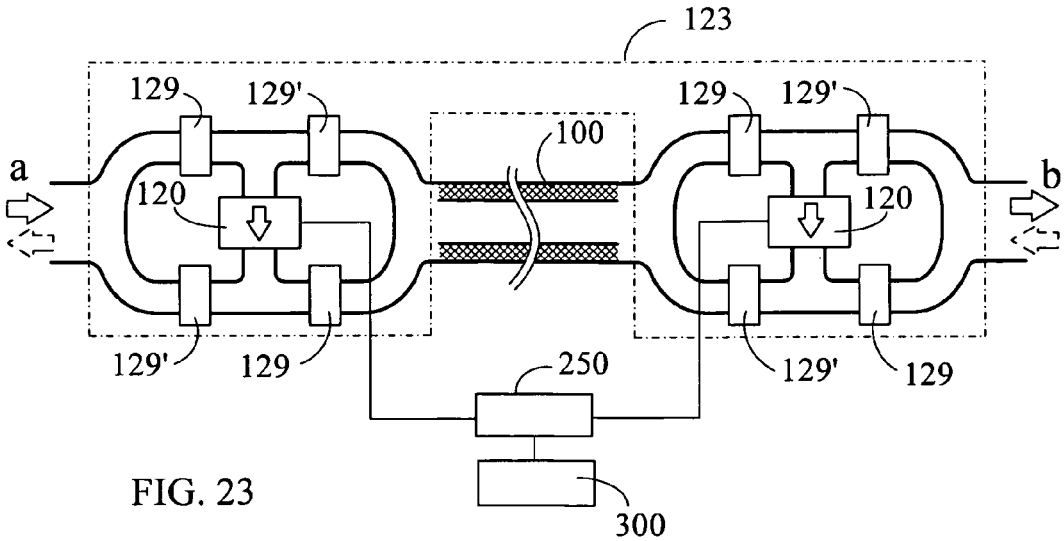
FIG. 23 shows that the heat exchanger has at least two unidirectional fluid pumps and four controllable switch type fluid valves in bridge type, and is installed on the first fluid port (a) and the second fluid port (b) at the two ends of the heat exchanger.

12. Having at least two unidirectional fluid pumps (120) and four controllable switch type fluid valves (129, 129') in bridge type combination, and installed on the first fluid port (a) and the second fluid port (b) at two ends of the heat exchanger (100) thereby to alternately control two fluid valves (129) to open and the other two fluid valves (129') to close or two fluid valves (120) to close and the other two fluid valves (129') to close. The at least two unidirectional fluid pumps (120) and four controllable switch type fluid valves (129, 129') are controlled by the periodic fluid direction-change operative control device (250) during the operation of the unidirectional fluid pump (120) to periodically change the fluid directions. As shown in FIG. 23, this embodiment has at least two unidirectional fluid pumps and four controllable switch type fluid valves in bridge type, which are installed on the first fluid port (a) and the second fluid port (b) at the two ends of the heat exchanger.

Said periodic fluid direction-change operative control device (250) of the single flow circuit heat exchange device for periodic positive and reverse directional pumping of the present invention is equipped with an electric motor, or controllable engine power, or mechanical or electric power generated or converted from other wind energy, thermal energy, temperature-difference energy, or solar energy for controlling various fluid pumps, or control the operational timing of the fluid pumps or fluid valves to change the direction of the two circuits passing through the heat exchanger (100) and further to operatively control partial or all functions of modulation including the rotational speed, flow rate, fluid pressure of various fluid pumps thereof.

For the aforementioned single flow-circuit heat exchange device for periodic positive and reverse directional pumping the periodic fluid direction-change operative control device (250) manipulates the flow rate of the fluid pumped by the bi-directional pumping device (123), where the flows are controlled by one or more of the following:

1) the flow rate of pumping fluid is adjusted or set manually;
2) the flow rate of fluid is controlled by referring to the detected signal of the at least one temperature detecting device;
3) the flow rate of fluid is controlled by referring to the detected signal of the at least one moisture detecting device;
4) the flow rate of fluid is controlled by referring to the detected signal of the at least one gaseous or liquid fluid composition detecting device;
5) the flow rate of the fluid is jointly controlled by two or more of the aforesaid operations.

The single flow-circuit heat exchange device for periodic positive and reverse directional pumping when controlling the flow rate, the flow rate range of the controlled fluid is stopped between delivery to the maximum delivering volume, and the flow rate of fluid is manipulated in stepped or stepless control where one or more of the following operations can also occur:

1) to operatively control the rotational speed during the pumping operation of bi-directional pumping device (123) from idling to the maximum speed range, thereby to further control the flow rate of fluid;
2) by adopting the bi-directional pumping device (123) with controllable fluid valve inlet/outlet to control the open volume of the fluid valve inlet/outlet of the bi-directional pumping device (123), thereby to further control the flow rate of fluid;
3) by adopting the unidirectional valve (126) with controllable fluid valve inlet/outlet to control the open volume of the fluid valve inlet/outlet of the unidirectional valve (126), thereby to further operatively control the flow rate of fluid;
4) by adopting the fluid valve (129) and fluid valve (129') with controllable fluid valve inlet/outlet to control the open volume of the fluid valve inlet/outlet of the fluid valve (129) and fluid valve (129'), thereby to further control the flow rate of fluid;
5) by controlling at least one of the devices in item 1)-4) to intermittingly pump fluid, thereby to modulate the average flow rate by the time ratio of pumping and stop pumping.

For the aforementioned single flow-circuit heat exchange device for periodic positive and reverse directional pumping, the flow rate ratio of the two flow circuits passing through the heat exchanger (100) or the total heat exchanger (200) can have one or more of the following ratios:

1) In the operation of periodically positive and reverse directional pumping fluid, the flow rate of fluid in one direction is greater than that of fluid in the other direction;
2) In the operation of periodically positive and reverse directional pumping fluid, the flow rates of the fluid in two directions are the same.

For the aforementioned single flow-circuit heat exchange device for periodic positive and reverse directional pumping during the periodically positive and reverse directional pumping, the pumping periodic mode includes one or more of the following:

1) during the operation of periodically positive and reverse directional pumping fluid, the operational time of positive direction and reverse direction are the same;
2) during the operation of periodically positive and reverse directional pumping fluid, the operational time of positive direction and reverse direction are different;
3) mixed modes of both item 1) and 2).

For the aforementioned single flow-circuit heat exchange device for periodic positive and reverse directional pumping, except for the function of periodically positive and reverse directional pumping operation, it further simultaneously has one or more the following:

1) the fluid of two flow circuits pumps in fluid in the same flowing direction;
2) the fluid of two flow circuits pumps out fluid in the reverse flowing direction.

The function of the same directional pumping of aforementioned two flow circuits can be applied for the requirement to emergently increase the flow rate of fluid pumping in or pumping out.

The heat exchanger or full heat exchanger of the single flow circuit heat exchange device for periodic positive and reverse directional pumping is embodied to have the following characteristics: 1) it is of the tubular structure in linear or other geometric shapes; 2) it is constituted by the multi-layer structure having fluid path for passing gaseous or liquid state fluids; or 3) it is constituted by a plurality of single flow path heat exchange device with one or more than one fluid path in connected in series, connected in parallel or connected in series and parallel.

For the single flow circuit heat exchange device for periodic positive and reverse directional pumping, during the operation of the flow direction change, to mitigate the impact generated by the gaseous or liquid state fluid in the course of pumping when the fluid flow is reversed, including the liquid hammer effect generated when the pumping liquid state fluid being interrupted, one or more of the following can be further added to the operational modes of the flow direction change control:

1) during the operation of fluid flow direction change, control of the fluid pump or fluid valve slowly reduces the flow rate of fluid, and is then switched to slowly increase the flow rate of fluid to a maximum preset value in the other flow direction;
2) during the operation of fluid flow direction change, control of the fluid pump or fluid valve slowly reduces the flow rate of fluid, and is then switched to stop pumping for a preset time period, then further to be switched to slowly increase the flow rate of fluid to a maximum preset value in the other flow direction.

The invention claimed is:

1. A device for exchanging heat comprising:

a heat exchanger comprising a single flow circuit, said single flow circuit having an inlet having a first fluid port and an outlet having a second fluid port said single flow circuit configured to receive a thermal conductive fluid;

at least one fluid pump coupled to the single flow circuit, said fluid pump configured to pump the thermal conductive fluid in a first direction or in an opposite second direction in the single flow circuit, wherein the at least one fluid pump is coupled to at least one of the first fluid port and the second fluid port of the single flow circuit;

a periodic fluid direction-change operative control device configured to control operations of the at least one fluid pump so that the periodic fluid direction-change operative control device is operable to periodically change a flow direction of the thermal conductive fluid from the first direction and the opposite second direction in the single flow circuit; and, at least one temperature detecting device installed at a position on the heat exchanger to detect a temperature variation of the thermal conductive fluid, wherein the periodic fluid direction-change operative control device is configured to periodically control the fluid flow direction of the thermal conductive fluid in one or more of the following operational modes:

a mode where the fluid flow direction is manually adjustable;

a mode where the fluid flow direction is operatively controlled by setting a time period for flowing thermal conductive fluid in the first and opposite second direction; and, a mode where the fluid flow direction is operatively controlled in the first and opposite second directions when a detected signal from the temperature detecting device reaches a set temperature.

2. The device for exchanging heat according to claim 1, wherein the at least one fluid pump is a bidirectional fluid pump.

3. The device for exchanging heat according to claim 1, further comprising at least a second detecting device, said at least second detecting device being a humidity detecting device, wherein the at least one second detecting device is positioned at a location on the heat exchanger such that the at least one second detecting device is positioned to detect given properties of the pumped fluid, wherein the periodic fluid direction-change operative control device is configured to use signals detected by the at least one temperature detecting device or by the second detecting device as a reference for operatively controlling the flow direction of the thermal conductive fluid based on a control scheme selected from a group consisting of: controlling the time in which the thermal conductive fluid flows in the first or opposite second directions, controlling a flow rate of the pumped thermal conductive fluid, and controlling a fluid valve to control the speed or the flow rate of the pumped thermal conductive fluid.

4. The device for exchanging heat according to claim 1, wherein the periodic fluid direction-change operative control device is configured to periodically change of the fluid flow according to at least one of the following operations:

an operation where the operational time for pumping the thermal conductive fluid in the first flow direction and pumping the thermal conductive fluid in the opposite second flow direction are the same; and, an operation where the operational time for pumping the thermal conductive fluid in the first flow direction and pumping the thermal conductive fluid in the opposite second flow direction are different.

5. The device for exchanging heat according to claim 1, further comprising two unidirectional fluid pumps, wherein a first unidirectional fluid pump and a second unidirectional fluid pump of the two unidirectional fluid pumps are coupled to at least one of the first fluid port and the second fluid port of the single flow circuit.

6. The device for exchanging heat according to claim 5, wherein the periodic fluid direction-change operative control device is further configured to mitigate an impact generated during a course of reversing pumping direction between the first or second directions of the thermal conductive fluid by operating in at least one of the following operational methods:

an operational method whereby when changing the fluid flow direction, the periodic fluid direction-change operative control device is configured to control at least one of the unidirectional fluid pumps to slowly reduce a flow rate of the thermal conductive fluid to no flow and then to switch the direction of the fluid flow and to slowly increase the flow rate of the thermal conductive fluid to a maximum preset value; and, an operational method whereby when changing the fluid flow direction, the periodic fluid direction-change operative control device is configured to control at least one of the unidirectional fluid pumps to slowly reduce a flow rate of the thermal conductive fluid to no flow and to stop the at least one unidirectional fluid pump for a preset time period, and then to control the other unidirectional fluid pump to pump the thermal conductive fluid in the opposite direction to slowly increase the flow rate of the thermal conductive fluid to a maximum preset value.

7. The device for exchanging heat according to claim 5, wherein the two unidirectional fluid pumps are configured to pump in different directions, and are connected in series, wherein the two unidirectional fluid pumps are both installed on either one of the first fluid port or the second fluid port of the single flow circuit, wherein the periodic fluid direction-change operative control device is configured to alternately control the first unidirectional fluid pump to periodically pump in the forward direction and to control the second unidirectional fluid pump to periodically pump in the reverse direction.

8. The device for exchanging heat according to claim 5, wherein the two unidirectional fluid pumps are configured to pump in different pumping directions, and are connected in series, wherein each of the two unidirectional fluid pumps is separately installed on the first fluid port and the second fluid port of the single flow circuit, wherein the periodic fluid direction-change operative control device is configured to control the unidirectional fluid pumps in different pumping directions.

9. The device for exchanging heat according to claim 5, wherein the two unidirectional fluid pumps are configured to pump in different pumping directions, and are connected in parallel, wherein the two unidirectional fluid pumps are both installed at the first fluid port or the second fluid port of the single flow circuit, wherein the unidirectional fluid pumps are connected in series with a unidirectional valve in forward polarity to avoid reverse flows.

10. The device for exchanging heat according to claim 1, further comprising at least a second detecting device, said at least second detecting device being a gaseous or liquid fluid composition detecting device, wherein the at least one second detecting device is positioned at a location on the heat exchanger to detect given properties of the pumped fluid, wherein the periodic fluid direction-change operative control device is configured to use the detected signals from the at least one temperature detecting device from the at least one second detecting device as a reference for operatively controlling the flow direction of the thermal conductive fluid based on a control scheme selected from the group consisting of: controlling the time in which the thermal conductive fluid flows in the first direction or in the opposite second direction; and, controlling a speed or a flow rate of the pumped thermal conductive fluid, and.

* * * * *